United States Patent [19]

Kinsey

[11] Patent Number: 4,896,423

[45] Date of Patent: Jan. 30, 1990

[54] EATING FORK

[76] Inventor: Walter J. Kinsey, 246 Mermaids Bite, Naples, Fla. 33940

[21] Appl. No.: 218,281

[22] Filed: Jul. 13, 1988

[51] Int. Cl.[4] ..... A47J 43/28

[52] U.S. Cl. ..... 30/322

[58] Field of Search ..... 30/150, 147, 142, 322–328

[56] References Cited

U.S. PATENT DOCUMENTS

D. 58,881 9/1921 Camellas ..... 30/150 X

FOREIGN PATENT DOCUMENTS 176680 3/1922 United Kingdom ..... 30/150

*Primary Examiner*—Douglas D. Watts

*Attorney, Agent, or Firm*—Merrill N. Johnson

[57] ABSTRACT

An improved eating fork having a conventional handle, an extended flat body portion and a plurality of short conical tines each having a small smoothly rounded end. The short tines project along parallel axes from the forward end of the flat body portion extending from the fork's handle. The body portion has a width slightly greater than the distance across the bases of the plurality of tines. The flat body portion of the improved fork contains in its upper surface a generally rectangular depression. The tines have a length about one fifth the length of the fork's flat body portion. The surfaces which join the tines to the flat body portion are all curved and all surfaces of the fork are polished during manufacture of the fork.

8 Claims, 2 Drawing Sheets

EATING FORK

BACKGROUND AND SUMMARY OF THE INVENTION

My invention relates to eating utensils and more particularly to an improved eating fork.

The general form and shape of eating utensils, commonly called flatware, has not changed in the past three hundred years. Except for many different designs of the handles of knives, spoons and forks made largely for aesthetic reasons, the general form and shape of the remainder of the flatware has remained substantially unchanged.

The present day fork having four identical tines or prongs which project along parallel axes from a short, flat body portion of uniform thickness originated in England in the 17th Century. Whether made from sterling silver, a base metal plated with silver or other metal providing a silver-like finish, or stainless steel, the general shape of the fork contained four elongated similar tines projecting from a short flat body portion connected to the handle of the fork.

Most metal forks are fabricated from a thin, flat blank of rolled metal. Hence, the name "flatware" for knives, spoons and forks. To form the blank into a fork having a handle, a short body portion and four elongated tines, the blank is sheared in a press. This leaves the fork with a total of five sheared surfaces, namely, the two outside edges of the fork extending down to the tips of the two outermost tines and the three elongated U-shaped surfaces between the four tines. Being sheared, these surfaces are relatively rough and depending upon the amount of shaping and polishing following the shearing operation, these surfaces offer areas for attachment of dirt, grease and other unsanitary material. Such areas provide breeding grounds for bacteria and other disease carrying organisms. The degree to which these sheared surfaces are smoothed and polished depends on how much time and money the manufacturer wishes to spend and this in turn is reflected in the price of the fork.

The major purpose of the fork as an eating utensil is, of course, to "spear" an item of food and hold that item either while it is being cut into bite-sized portions or to convey an item of food which may or may not be speared from the plate and into the mouth. However, the "spearing" operation does not require the entire length of the conventional prongs or tines in use today.

I have determined that it would be less expensive and more practical and hygenic to make the tines of the fork much shorter than conventional forks. The only practical reason for making present day tines as long as they are is to provide an irregular upper surface which prevents food from falling off the fork on its way from the plate to the mouth.

Prior fork designs which recognize the foregoing facts are shown in German Patent 388,822 published Jan. 24, 1924 and U.S. Design Patent No. 148,984 issued Mar. 16, 1948. However, the forks shown in these prior patents do not in my opinion present the pleasing appearance of a conventional fork and contain surfaces which are difficult to clean.

Accordingly, I have designed an improved eating fork which retains the overall dimensions of the present day fork, but which has tines which are only twenty to twenty-five percent of the length of the tines of conventional forks. Moreover, in the interest of both appearance and increased ease of cleaning the tines are preferably conical with hemispherical ends and all flat surfaces of the body portion of the fork are connected by surfaces which in cross-section are curves or reverse curves.

Since the body portion of the fork between the tines and the handle no longer has the rounder upper surfaces of the elongated tines, especially the two outermost tines, to prevent food from falling off the fork, I provide a generally rectangular indentation or depression in the upper surface of the body of the fork which I have found is all that is necessary to prevent food from falling off my improved fork.

My improved fork retains the overall length, width, thickness and general shape of conventional present day forks. The reason for this is that the general public has become so accustomed to seeing and using present day forks with beautifully designed handles and graceful body shape, that it would be next to impossible for most persons to accept a fork having a different overall appearance.

While retaining the general shape of the present day fork, my improved fork has short conical tines with hemispherical rounded ends rather than sharp pointed ends. The surfaces at the bases of the tines which join the tines to the body portion of the fork are all smoothly curved and highly polished as are the tines themselves both for aesthetic and hygenic reasons. In order to retain food upon the body portion of the fork, a slight indentation or depression is provided in its upper surface, again using curved and reverse curves connecting the flat upper surface of the fork to the flat bottom surface of the depression.

The cost of manufacture of my improved eating fork would be somewhat less than the cost of high quality forks of conventional design. The reasons for this are:

a. The blanking die for a fork with short prongs would be less expensive.

b. The cost of periodic sharpening the blanking die for a fork with short prongs would be less.

c. Few replacement punches and fewer new dies would be required.

d. The indentation in the top surface of the body portion of the fork could be formed by incorporating the indentation into the forming die at a modest increase in cost of the forming die.

e. To eliminate the added cost of machining the desired conical tines and forming the desired curved and reverse curved areas, the fork could be made by hot forming from a round bar, then trimming the flash and polishing the hot formed fork.

f. Whether made from a flat blank by shearing or from a bar by hot forming, the rejection rate of a short pronged fork would be less than a long pronged fork.

I have conducted numerous tests to prove the utility and versatility of my improved fork. Many foods have been eaten with my improved fork and none have presented any difficulties in picking up the food and moving it from the plate to the mouth. Foods which might be considered difficult to eat such as lettuce, peas, corn, lima beans, various cheeses, hot cakes, eggs, tortellini, watermellon and noodles have been eaten without any problem. No trouble was experienced rolling spaghetti onto the fork and getting it into the mouth.

My wife and I have regularly eaten meals using my improved fork for several weeks and both of us like the feel of the fork in use and particularly the feeling on the lips as the fork is withdrawn from the mouth.

BRIEF DESCRIPTION OF THE DRAWINGS

In the appended drawings I have illustrated a preferred embodiment of my improved eating fork in which.

DETAILED DESCRIPTION OF THE PREFERRED EMBODIMENT

Figure 1:
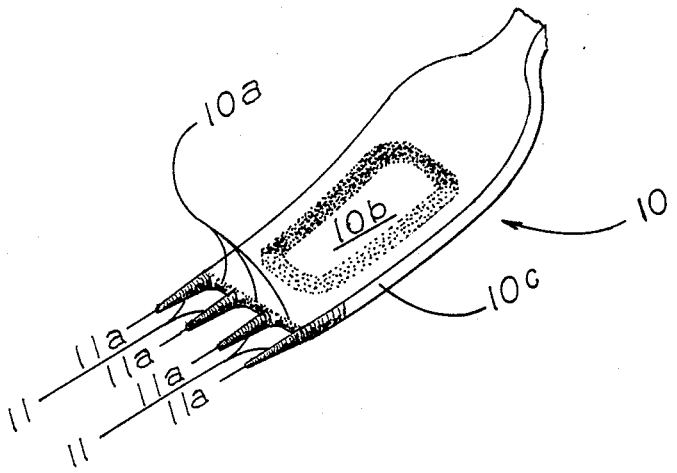
FIG. 1 is a perspective view taken from above of the preferred embodiment with the fork's handle broken away since the handle is conventional and forms no part of my invention.

Referring first to FIG. 1 of the drawings, my improved eating fork 10 is shown in perspective but with the fork's handle broken away since the handle may be of any conventional design and forms no part of my invention. FIG. 1 shows only the "business end" of fork 10 which retains the overall appearance and form of a present day conventional fork.

However, fork 10 comprises a handle (not shown), a flat extended body portion and four short conically tapered tines 11 each ending in a hemispherically rounded end 11*a*. The total length of tines 11 measured from their base to the tips of their rounded ends 11*a* is about one fifth of the extent of the body portion of the fork, that is, measured from the joinder of the handle and the body portion to the line of joinder of the base of the tines to the front edge of the body portion of the fork.

As an aid in preventing items of food from falling off the fork during the passage of the business end of fork 10 from the plate to the mouth, a generally rectangular indentation or depression 10*b* is stamped or otherwise formed into the upper flat surface of the fork. Both for aesthetic and hygenic reasons, the surfaces which lie between the center flat face of depression 10*b* and the upper flat surface of the fork's body portion are smoothly curved and in cross-section consist of curves and reverse curves.

Figure 2:
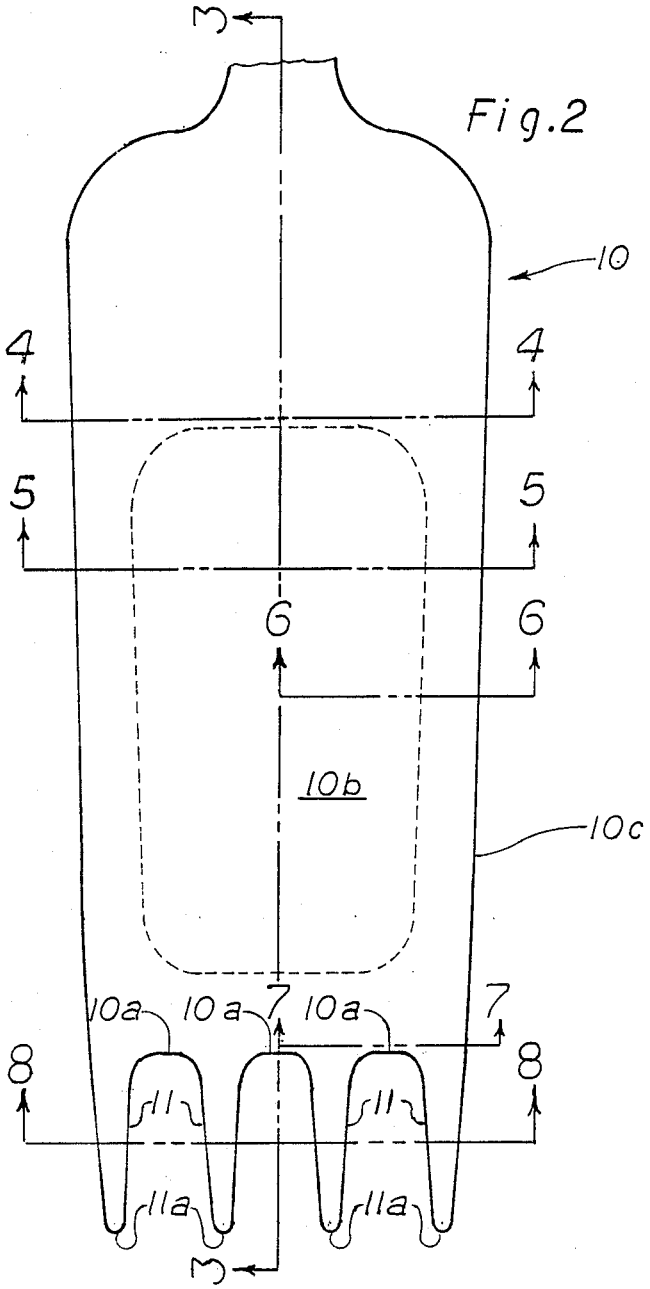
FIG. 2 is a top plan view of the fork shown in FIG. 1.
Figure 3:
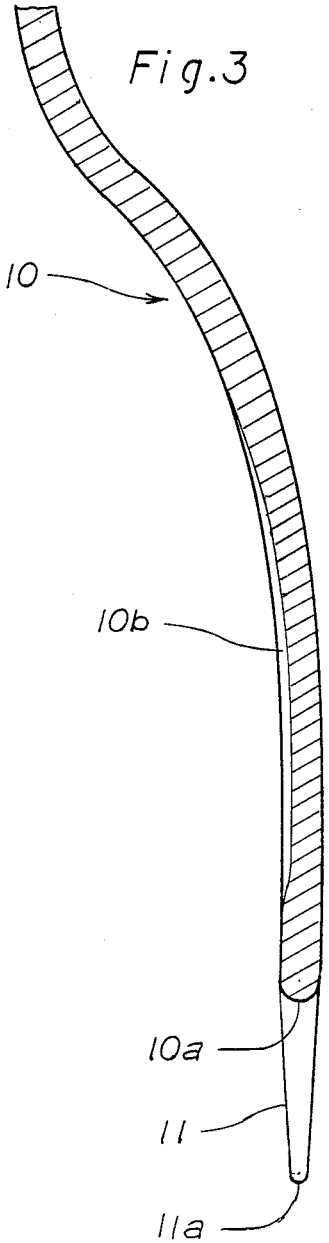
FIG. 3 is a cross-sectional side view taken along line 3—3 of the fork shown in FIG. 2.
Figure 4:
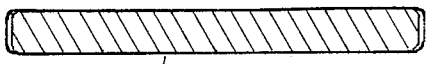
FIG. 4 is a cross-sectional front view taken along line 4—4 of the fork shown in FIG. 2.
Figure 5:
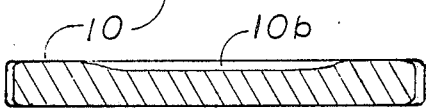
FIG. 5 is a cross-sectional front view taken along line 5—5 of the fork shown in FIG. 2.
Figure 8:
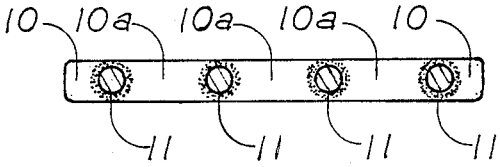
FIG. 8 is a front elevational view partially in cross-section taken along line 8—8 of the fork shown in FIG. 2.
Figure 7:
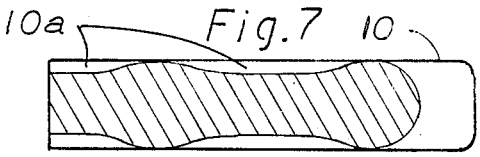
FIG. 7 is a front view partially in cross-section taken along line 7—7 of the fork shown in FIG. 2.
Figure 6:
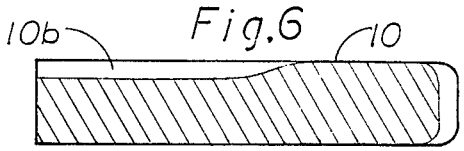
FIG. 6 is a front view partially in cross-section taken along line 6—6 of the fork shown in FIG. 2.

Likewise, the surfaces 10*a* best shown in FIGS. 1, 2, and 3 which connect the bases of tines 11 with the front of the body portion of fork 10 are all smoothly curved and in cross-section are curves and reverse curves which like the tines are highly polished during the manufacturing process. Such smoothly curved and polished surfaces cannot provide a breeding ground for disease carrying organisms.

Fork 10 may be made of sterling silver, from a base metal such as steel and then plated with silver or other metal which gives a silver-like appearance to the fork, or stainless steel which requires no plating.

The sides 10*c* of the body portion of fork 10 as best shown in FIG. 1 and FIGS. 4 through 8 are essentially flat surfaces which adjoin the flat upper and lower surfaces of the body portion of the fork over smoothly curved upper and lower edges.

While I have illustrated and described in detail a preferred embodiment of my improved eating fork, it is apparent that variations and modifications may be made without departing from the spirit and scope of my invention, as those skilled in the art will understand. The foregoing description is made without intending in any way to limit my invention whose scope is spelled out only in the appended claims.

I claim:

1. An eating fork comprising a handle, and extended flat body portion, and a plurality of short conical tines each having a small smoothly rounded end, said tines projecting along parallel axes from the forward end of the flat body portion, said body portion having a width slightly greater than the distance across the bases of the plurality of tines, said flat body portion having in its upper surface a generally rectangular shallow depression having a depth of about 25% or less of the body thickness, said tines having a length about one fifth the length of the extended flat body portion, the fork surface including the surfaces joining the tines to the flat body portion and the shallow depression being smoothly curved and all surfaces of the fork being polished during manufacture.

2. An eating fork comprising a handle, an extended flat body portion and a plurality of short truncated tines each having a small smoothly polished end, said tines projecting along parallel axes from the forward end of the flat body portion, said flat body portion having in its upper surface a shallow generally rectangular depression having a depth of about 25% or less of the body thickness, and the fork surfaces including the surfaces joining the tines to the flat body portion and the shallow depression being smoothly curved.

3. An eating fork as set forth in claim 1 wherein the shallow depression in the upper surface of the fork's flat body portion has a flat bottom surface which is joined to the flat upper surface of the fork's body portion by smoothly curved sides.

4. An eating fork as set forth in claim 2 wherein the shallow depression in the upper surface of the fork's flat body portion has a flat bottom surface which is joined to the flat upper surface of the fork's body portion by smoothly curved and polished sides.

5. An eating fork as set forth in claim 2 wherein all surfaces of the fork being polished during manufacture.

6. An eating fork comprising a handle, an elongated body portion of uniform thickness having one end joined to the handle and its forward end joined to a plurality of short truncated tines each having a small smoothly rounded end, said tines projecting along parallel axes from the forward end of the flat elongated body portion, said body portion having a width slightly greater than the distance across the bases of the plurality of tines, said flat body portion having in its upper surface a shallow depression having a depth of about 25% or less of the body thickness, said tines having a length of about one fifth the length of the elongated flat body portion, and the fork surfaces being smoothly curved.

7. An eating fork as set forth in claim 6 wherein the shallow depression in the upper surface of the fork's body portion has a generally rectangular flat bottom surface which is joined to the upper surface of the fork's body portion by smoothly curved sides.

8. an eating fork as set forth in claim 6 wherein all surfaces of the fork are polished during manufacture.

* * * * *